US006003708A

United States Patent [19]

Meyering

[11] Patent Number: 6,003,708

[45] Date of Patent: Dec. 21, 1999

[54] BOX

[75] Inventor: Samuel Cornelis Meyering, Maarssen, Netherlands

[73] Assignee: Otterspoor Produkties B.V., Maarssen, Netherlands

[21] Appl. No.: 09/076,211

[22] Filed: May 12, 1998

Related U.S. Application Data

[63] Continuation of application No. PCT/NL96/00455, Nov. 15, 1996.

[30] Foreign Application Priority Data

Nov. 15, 1995 [NL] Netherlands ..... 1001653

[51] Int. Cl.[6] ..... B65D 6/00

[52] U.S. Cl. ..... 220/6; 220/520; 229/120.01

[58] Field of Search ..... 220/6, 507, 520; 229/120.01

[56] References Cited

U.S. PATENT DOCUMENTS

| | | | |
|---|---|---|---|
| 298,569 | 5/1884 | Foster | 220/520 X |
| 2,718,447 | 9/1955 | Wright | 220/520 X |
| 3,058,579 | 10/1962 | Morin et al. | 220/520 X |
| 4,998,616 | 3/1991 | Hillinger | 220/520 X |

FOREIGN PATENT DOCUMENTS

| | | |
|---|---|---|
| 1452859 | 9/1966 | France . |
| 2050532 | 4/1971 | France . |
| 168531 | 9/1921 | United Kingdom . |
| 2034669 | 6/1980 | United Kingdom . |

*Primary Examiner*—Steven Pollard

*Attorney, Agent, or Firm*—Akin, Gump, Strauss, Hauer & Feld, L.L.P.

[57] ABSTRACT

A box is provided with a number of holders (1, 2, 3, 4), all of which have a bottom, end walls and side walls, with always at least two adjacent holders having a pivoting connection (9, 10) at their bottom. The holders (1, 2, 3, 4) are of such dimensions that when they are in the folded state, an earlier folded holder will close off an adjacent outside holder. At least the first holder is connected with two adjacent other holders, such that the pivoting connections are positioned at right angles to each other.

4 Claims, 4 Drawing Sheets

BOX

CROSS-REFERENCE TO RELATED APPLICATION

This is a continuation of International Application No. PCT/NL96/00455, filed Nov. 15, 1996.

BACKGROUND OF THE INVENTION

The present invention relates to a box provided with a number of holders, all of which have a bottom, end walls and side walls, with always at least two adjacent holders having a pivoting connection at their bottom and the holders being of such dimensions that when they are in the folded state, an earlier folded holder will close off an adjacent outside holder, and wherein the pivoting connections of each of these two holders with adjacent holders are positioned at right angles to each other, such, that in the unfolded state two adjoining rows of holders are provided.

Such a box is known from Dutch patent application 7810935 (U.K. patent application GB 2034 669B). This known foldable box is used for many purposes such as for storing screws, nuts and other small technical parts, as a sewing box, cigar and cigarette box, but also as a box for storing make-up articles and with provisions for storing eye-shadow and the like. GB-A-168531, in particular FIGS. 18 and 19 disclose a box as described at the outset.

In order to obtain access to the various holders of the known box, the box can be folded out into a flat extended position in which the holders are connected in series forming a long row. The disadvantage of this is that, if the box is provided with a great number of holders, it takes up much space when extended. This is detrimental to its ease of use. A further drawback of the known box is that the holders, if they are part of a rectangular box, may have greatly varied dimensions. Especially the holders that are on the inside, when the box is in its folded state, often have an impractical narrow shape, while the holders positioned more on the outside are more square of shape. In view of practicability, such a great variety of holder shapes is not always desirable.

SUMMARY OF THE INVENTION

It is now the object of the invention to provide a box of the kind described in the background from which these problems are removed.

To this end, the box according to the invention is characterized in that at least a first holder is connected with two adjacent other holders, such that the pivoting connections of each of these two holders are positioned at right angles to each other, such that in the unfolded state two adjoining rows of holders are provided. This allows the holder to be unfolded onto a smaller vacant surface and to adapt the shape of the respective holders to each other to a certain extent.

A further embodiment of the box according to the invention is characterized in that three or more holders have pivoting connections to adjacent holders which are positioned at right angles to each other, such that the holders can be unfolded helically so as to restrict the distance between the both extremities of the box when in the unfolded state.

BRIEF DESCRIPTION OF THE DRAWINGS

The foregoing summary, as well as the following detailed description of the invention, will be better understood when read in conjunction with the appended drawings. For the purpose of illustrating the invention, there are shown in the drawings embodiment(s) which are presently preferred. It should be understood, however, that the invention is not limited to the precise arrangements and instrumentalities shown. In the drawings.

Identical parts in the Figures are indicated by the same reference numbers.

DETAILED DESCRIPTION OF THE INVENTION

Figure 1:
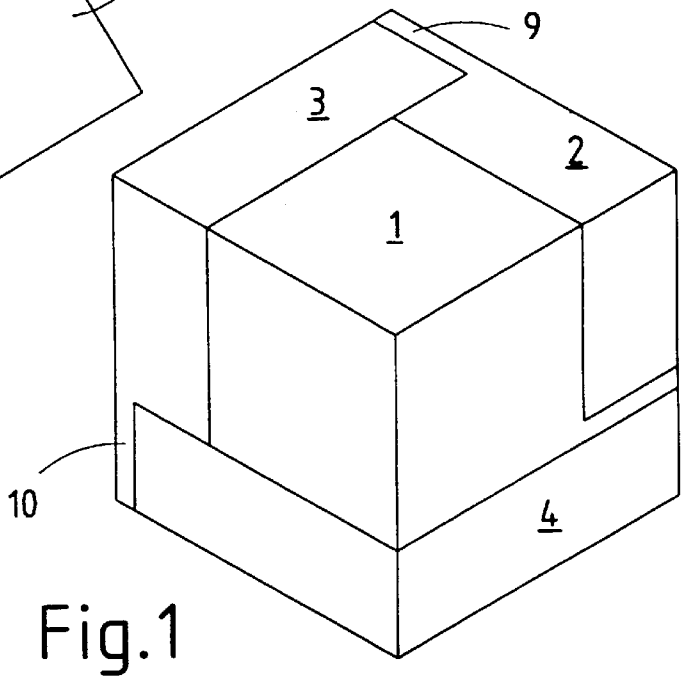
FIG. 1 shows a first embodiment of the box according to the invention in the folded state.
Figure 2:
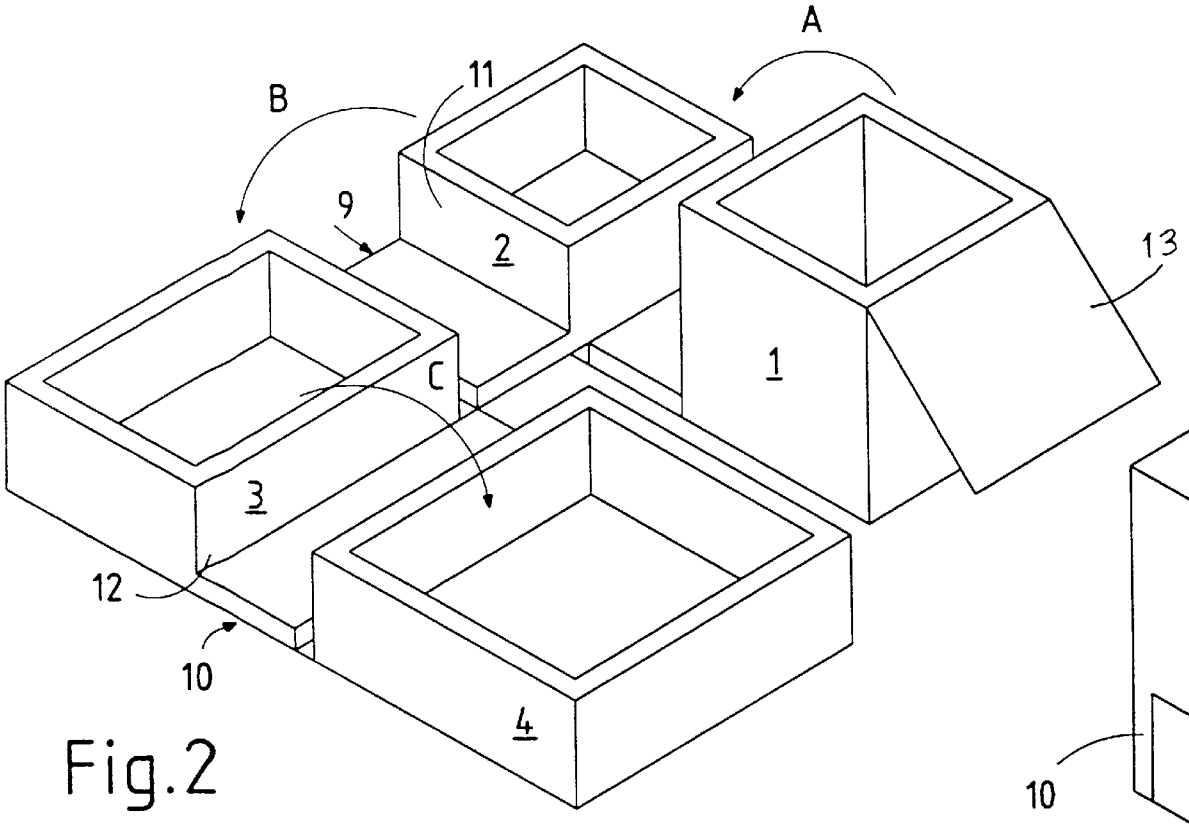
FIG. 2 shows the box of FIG. 1 in the unfolded state.

FIGS. 1 and 2 show a box in four parts comprising holders 1, 2, 3, and 4. Between the holders 2 and 3 a pivoting connection 9 is provided, and between the holders 3 and 4 a pivoting connection 10 is provided, by which means the holder 3 can be raised for placing against a wall 11 of the holder 2, and the holder 4 can be tilted up for placing against a wall 12 of holder 3. Holder 1 may be provided with a separate lid 13. Departing from the unfolded state as shown in FIG. 2, the box is brought into the closed configuration of FIG. 1 by, in succession closing the lid 13 of the holder 1 and then tilting the holder 1 in the direction of arrow A in order to close holder 2, after which holder 1 and 2 may be tilted further in the direction of arrow B in order to close holder 3. Finally, holder 4 is closed by tilting the assembly of holders 1, 2 and 3 in the direction of arrow C. Of course, the box can also be closed by folding in the opposite direction, but this is less desirable if the holder contains loose elements. According to the invention, the connecting pieces 9 and 10, which are both joined to holder 3, are at right angles to each other.

Figure 3:
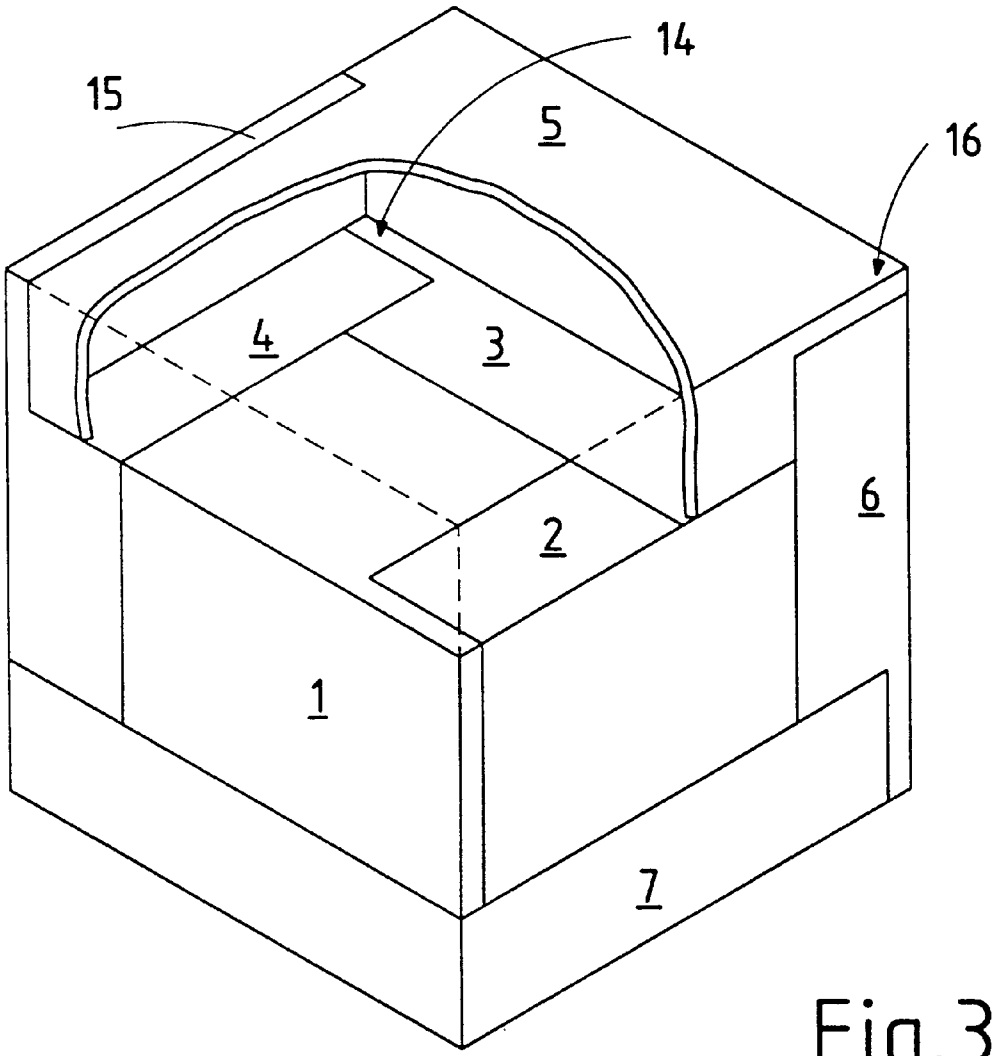
FIG. 3 shows a second embodiment of the box according to the invention in the folded state.
Figure 4:
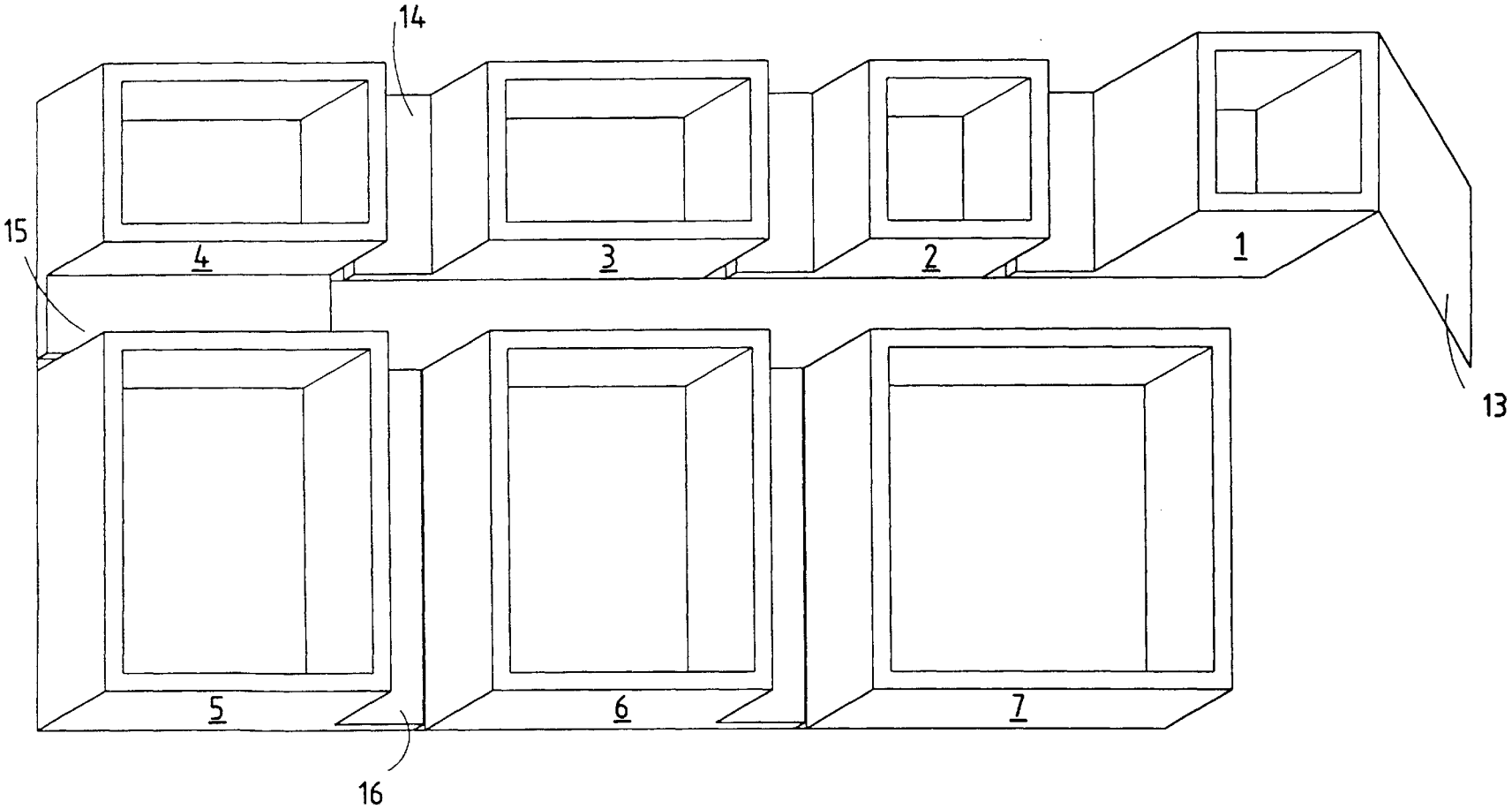
FIG. 4 shows the box of FIG. 3 in the unfolded state.

FIGS. 3 and 4 show an embodiment having seven boxes 1 to 7. FIG. 3 shows the box in the folded state, and FIG. 4 shows the same box in the unfolded state. Both holder 4 and holder 5 are joined to adjacent holders by means of pivoting connecting pieces which are positioned at right angles to each other. For holder 4 this is the connecting piece 14 between holder 3 and holder 4, as well as the connecting piece 15 between holder 4 and holder 5. For holder 5 this is the connecting piece 15 between holder 4 and holder 5, as well as the connecting piece 16 between holder 5 and holder 6. FIG. 3 shows holder 5 partly exploded and in the folded state to afford a better view at the way in which the inner holders 3 and 4 abut to holder 1. For the rest, folding the box into the closed state, as shown in FIG. 3, takes place in the same way as described above for the box shown in FIGS. 1 and 2.

Similarly (not shown, but to be carried out in the same manner described above), three or more holders can be provided with pivoting connections which are positioned at right angles to each other having adjacent holders, such that the holders can be unfolded helically.

Figure 5:
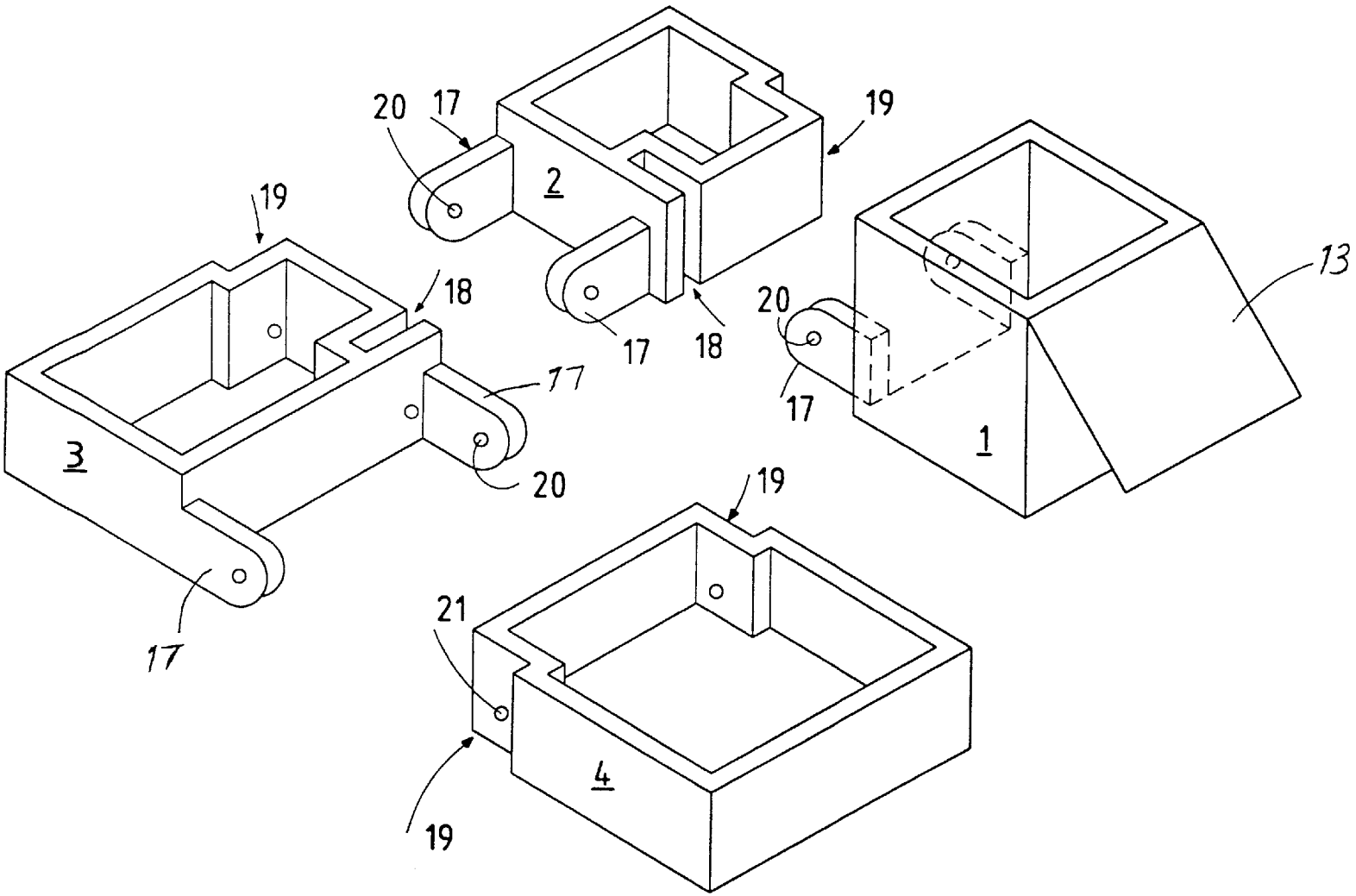
FIG. 5 shows a number of loose holders of the box according to the invention.

Finally, FIG. 5 shows a number of loose holders 1, 2, 3 and 4 of the box according to the invention, exhibiting the possible measures for providing the pivoting connections between the various holders. To this end, the holders 2, 3 and 4 are provided at one side with, for instance, slots 18 or recesses 19 interacting with lips 17 which are joined onto the holders 1, 2, and 3 respectively. To this end, the lips are provided with, for instance, small protrusions 20 which fit into corresponding hollows 21, in recesses 19 and slots 18 of a holder to be connected. Such provisions are simple to make if the holders are manufactured by means of injection moulding. An alternative connection can be made by means of a tenon and mortise construction.

It will be appreciated by those skilled in the art that changes could be made to the embodiment(s) described above without departing from the broad inventive concept thereof. It is understood, therefore, that this invention is not limited to the particular embodiment(s) disclosed, but it is intended to cover modifications within the spirit and scope of the present invention as defined by the appended claims.

I claim:

1. A box comprising a plurality of individual, open top holders, each holder having a bottom, a pair of an opposed side walls and a pair of opposed end walls, each holder being connected to at least one adjacent holder by a pivotal connection proximate the holder bottoms, the holders being sized and arranged so that when in an unfolded state, the holders form two adjacent rows with the holder bottoms being coplanar, the box being formed by successively pivoting holders with respect to adjacent holders such that a first holder, when pivoted with respect to a second holder covers the open top of the second holder, the first and second holders, when pivoted with respect to the third holder cover the open top of the third holder and so on until the holders are so pivoted to form a composite box.

2. The box according to claim 1 wherein the pivotal connection between adjacent holders comprises a slot in one of the holders and a rotatable lip in the other holder, the lip being received within the slot to form the pivotal connection.

3. A box comprised of four individual open top holders, each holder having a bottom, a pair of opposed sidewalls and a pair of opposed end walls, each holder being connected to at least one adjacent holder by a pivotal connection proximate the holder bottoms, the holders being sized and arranged such that when in an unfolded state, the holders form two adjacent rows with the holder bottoms being coplanar, the box being formed by pivoting a first holder with respect to a second holder such that the first holder covers the open top of the second holder, pivoting the first and second holders with respect to the third holder such that the first and second holders cover the open top of the third holder and pivoting the first, second and third holders with respect to the fourth holder such that the first, second and third holders cover the open top of the fourth holder and thereby form the box.

4. The box as recited in claim 1 wherein the first holder further includes a closable lid.

* * * * *